US007243436B2

(12) United States Patent
Casner et al.

(10) Patent No.: US 7,243,436 B2
(45) Date of Patent: Jul. 17, 2007

(54) T-BEVEL PLUMB TOOL

(76) Inventors: David Patrick Casner, 5393 Italian Creek Rd., Mariposa, CA (US) 95338; Daniel Bernard Casner, 5393 Italian Creek Rd., Mariposa, CA (US) 95338

( * ) Notice: Subject to any disclaimer, the term of this patent is extended or adjusted under 35 U.S.C. 154(b) by 0 days.

(21) Appl. No.: 11/335,146

(22) Filed: Jan. 19, 2006

(65) Prior Publication Data

US 2006/0168835 A1 Aug. 3, 2006

Related U.S. Application Data

(60) Provisional application No. 60/648,356, filed on Jan. 28, 2005.

(51) Int. Cl.
*B43L 7/00* (2006.01)

(52) U.S. Cl. ..... 33/473; 33/451; 33/471

(58) Field of Classification Search ..... 33/473, 33/404, 451, 452, 464, 465, 470, 471, 370, 33/371, 374, 376
See application file for complete search history.

(56) References Cited

U.S. PATENT DOCUMENTS

| | | | | | |
|---|---|---|---|---|---|
| 252,065 | A * | 1/1882 | Thomas | 33/473 |
| 649,422 | A * | 5/1900 | Fry et al. | 33/451 |
| 704,369 | A * | 7/1902 | Pritt | 33/451 |
| 1,489,572 | A * | 4/1924 | Bennewitz | 33/376 |
| 1,994,023 | A * | 3/1935 | Koelman | 33/473 |
| 2,656,609 | A * | 10/1953 | Siggson | 33/452 |
| 3,225,451 | A * | 12/1965 | Olexson et al. | 33/347 |
| D220,061 | S * | 3/1971 | Kerns | D10/62 |
| 4,955,141 | A * | 9/1990 | Welch | 33/418 |
| 5,839,201 | A | 11/1998 | Young | |
| 6,568,095 | B2 * | 5/2003 | Snyder | 33/370 |

* cited by examiner

*Primary Examiner*—Christopher W. Fulton
(74) *Attorney, Agent, or Firm*—Richard A. Ryan

(57) ABSTRACT

A t-bevel plumb tool configured for identifying and placing a plumb line has the components typical of a t-bevel, namely a handle and a blade that pivotally attaches to the handle, and a plumb indicator that, in one embodiment, removably attaches to one end of the blade. In this embodiment, a locking mechanism secures the blade to the first end of the handle and a plumb locking member attaches the plumb indicator to the second end of the blade during use as a plumb tool. When the plumb indicator is not being used for finding a plumb line, it attaches to an extension member at the second end of the handle. In another embodiment, the plumb indicator is incorporated into the locking mechanism that secures the blade relative to the handle and a separate level indicator is also incorporated into the handle.

7 Claims, 3 Drawing Sheets

T-BEVEL PLUMB TOOL

CROSS-REFERENCE TO RELATED APPLICATIONS

This application claims the benefit of U.S. Provisional Application No. 60/648,356 filed Jan. 28, 2005.

BACKGROUND OF THE INVENTION

A. Field of the Invention

The field of the present invention relates generally to hand tools utilized during construction activities. More specifically, this invention relates to tools utilized to configure structural components to be plumb and level. Even more specifically, the present invention relates to adjustable, collapsible hand tools having one or more components thereon to assist the user with finding plumb and level conditions and determining angle measurements.

B. Background

During the construction of a structure or structural components, including roofs, cabinets and other structures, the user is often required to cut, attach, install or otherwise manipulate materials so that they are in a plumb or level condition. For instance, when constructing a roof for a building the rafters, which are the series of structural members that run up and down the roof slope that are configured to support the roof load, typically extend past or have an extension portion that extends past the side of the structure to form an overhang or soffit area. The overhang portion of the rafter is generally referred to as the rafter tail. Most modern homes and other buildings attach a fascia, which is a vertically configured board that faces outward from the structure, to the ends of the rafter tails to provide a more finished look to the roof. Proper installation of the fascia requires cutting rafter tails in a uniform and plumb manner such that the fascia plate is substantially vertical and does not have a wave-like or other undesirable look along its length. Typically, the plumb cut at the end of the rafter is found by using the rise and run figures of the common rafter with a variety of hand tools, such as a steel square, chalk line, tape measure and level. The use of all of these tools can be time consuming and awkward. The need to utilize various measurement, level and plumb tools also arises during the installation and/or construction of cabinets, siding and various other structural components of a building or other structure.

A very common hand tool that is utilized in the construction industry to measure and reproduce angles is the sliding t-bevel. The typical t-bevel has a handle portion and a slotted blade portion that is slidably attached through the slot to one end of the handle portion. A locking member, such as a locking wing nut or other type of locking screw, interconnects the slot portion of the blade to the handle and is utilized to set the angle of the blade relative to the handle and the amount which the blade extends on either side of the handle. In its non-use condition, with the blade and handle placed in a linear condition, the handle is configured with an opening such that part of the blade will be disposed inside the handle. The typical handle portion is four to six inches long and the typical blade portion is seven to ten inches long. Utilizing the t-bevel, the user can set an angle by locking the t-bevel's blade relative to its handle at the desired angle in order to maintain that angle when marking materials for cutting or positioning materials for installation. The user can also utilize the t-bevel to measure the angle of an existing component, such as the pitch of a roof, by placing the handle and blade portions of the t-bevel in alignment with the component, locking the portions in place relative to each other and then placing the t-bevel on a protractor or other angle measuring device.

Another common hand tool utilized in the construction industry to install structural components in their proper and/or desired manner is the straight edge level. The typical level is an elongated tool having one or more straight edges and one or more "bubble" vials configured to indicate whether the edge of the tool, which is placed against the structural component of interest, is level or not. A common configuration for a level is to have three or more vials, one each to determine plumb, level and 45 degrees. Levels are typically configured out of aluminum, fiberglass, plastic or other lightweight materials with a plurality of acrylic vials disposed in the level between its parallel straight edges. Levels may also be configured with one or more openings for hand grips.

Although a variety of tools are available for use in the construction industry to measure and layout angles in order to obtain a plumb cut, none of the presently existing tools do so in a convenient and easy to use manner. For instance, the process of marking rafter tails to cut the end plumb for installation of the fascia board requires multiple tools and measurements due to the uneven nature of the various rafters. What is needed is a single hand tool that simplifies and increases the accuracy of measuring and laying out of angles during the construction and/or installation of structural components, such as roofs, cabinets, siding and the like. The preferred measuring and laying out tool is a t-bevel plumb tool that allows the user to measure or set an angle relative to the plumb condition. The preferred t-bevel plumb tool should be configured with the standard, familiar components of a t-bevel (namely a handle, blade and locking mechanism) with the addition of a bubble vial component so the user can be sure that the measurement or layout is plumb. Preferably, the bubble vial component is disposed on the t-bevel so as to not interfere with the normal or non-plumb operation of the t-bevel and to allow the blade portion to be partially disposed inside the handle during non-use. It is also preferred that the t-bevel be configured to have a longer handle and blade lengths than the standard t-bevel to better facilitate its use for plumb purposes.

SUMMARY OF THE INVENTION

The t-bevel plumb tool of the present invention provides the benefits and solves the problems identified above. That is to say, the present invention discloses a t-bevel tool that allows the user to quickly and accurately measure and layout plumb lines without having to utilize multiple tools and operations of various tools. The t-bevel tool of the present invention is configured like the standard, familiar t-bevel with the addition of a bubble vial component that is disposed on the t-bevel to indicate plumb conditions and to facilitate the measurement or determination of various angles (i.e., the pitch of a roof). The t-bevel plumb tool of the present invention does not interfere with the normal operation of the t-bevel and can be configured out a variety of different materials. In the preferred embodiment, the t-bevel plumb tool is provided with longer handle and blade components than presently available t-bevels.

In one general aspect of the present invention, the t-bevel plumb tool includes a handle having an opposing first and second ends, a blade pivotally attached to the first end of the handle, a blade slot disposed in the blade between the blade's first and second ends, a locking mechanism in the blade slot for locking the blade relative to the handle and a plumb indicator integral with the handle or attached to the blade such that the one of the pair of blade side edges define the desired plumb line. In one of the preferred embodiments, the plumb indicator is removably attached to the second end of the blade. Also in this preferred embodiment, the plumb indicator has a sleeve member with a sleeve slot therein, a plumb securing mechanism for securing the sleeve member to the blade and a plumb indicating mechanism, such as a bubble vial, for indicating when one of the pair of side edges defines the plumb line. The sleeve slot is sized and configured such that the second end of the blade is received in the sleeve slot so that the plumb securing mechanism secures the sleeve member to the blade. Preferably, the second end of the handle has an extension member that is sized and configured to be received in the sleeve slot so that the plumb indicator can be positioned on the extension member when the t-bevel plumb tool is not being utilized as a plumb tool. The plumb securing mechanism is configured to also secure the plumb indicator to the extension member. Preferably, the extension member is integral with the second end of the handle. In use, the t-bevel plumb tool will be typically carried with the handle and blade in a substantially linear relationship, generally with the blade at least partially disposed in the handle and the plumb indicator on the extension member. To use the t-bevel plumb tool the user loosens the plumb securing mechanism and removes the plumb indicator from the extension member and attaches it to the second end of the blade. Once in place, the user utilizes the t-bevel plumb tool to quickly, easily and accurately draw a plumb line on a rafter tail (as an example). When the user is done using the tool, he or she loosen the plumb securing mechanism to remove the plumb indicator from the second end of the blade and then reattaches it to the extension member at the second end of the handle.

In another general aspect of the t-bevel plumb tool of the present invention, the plumb indicator is incorporated into the first end of the handle and the locking mechanism utilized to pivotally attach the blade to the handle. The plumb indicator can have a base section that is received in a cavity at the first end of the handle with a threaded member extending outwardly from the base member to connect to a nut or other threaded receiving member on the opposite side of the handle. The area around the cavity can be provided with a dial-type of indicator that indicates the angles of the blade. A level indicator can be built into the handle, such as at or near the second end of the handle.

Accordingly, the primary objective of the present invention is to provide a t-bevel plumb tool that provides the advantages discussed above and that overcomes the disadvantages and limitations associated with presently configured t-bevels and other levels.

It is also an object of the present invention to provide a t-bevel plumb tool that is configured to allow the user to quickly and easily measure and/or layout a plumb line relative to an angled member.

It is also an object of the present invention to provide a t-bevel plumb tool that is configured as a familiar t-bevel with the addition of a plumb indicator, such as a bubble vial, to allow the user to determine or measure plumb conditions.

It is a further object of the present invention to provide a t-bevel plumb tool that does not interfere with the normal t-bevel operation and which is provided with longer handle and blade components.

The above and other objectives of the present invention will be explained in greater detail by reference to the attached figures and the description of the preferred embodiment which follows. As set forth herein, the present invention resides in the novel features of form, construction, mode of operation and combination of processes presently described and understood by the claims.

BRIEF DESCRIPTION OF THE DRAWINGS

In the drawings which illustrate the preferred embodiments and the best modes presently contemplated for carrying out the present invention.

DETAILED DESCRIPTION OF THE PREFERRED EMBODIMENTS

With reference to the figures where like elements have been given like numerical designations to facilitate the reader's understanding of the present invention, the preferred embodiments of the present invention are set forth below. The enclosed figures and drawings are merely illustrative of a preferred embodiment and represents one of several different ways of configuring the present invention. Although specific components, materials, configurations and uses are illustrated, it should be understood that a number of variations to the components and to the configuration of those components described herein and in the accompanying figures can be made without changing the scope and function of the invention set forth herein. The enclosed description and drawings are merely illustrative of preferred embodiments and represent several different ways of configuring the present invention.

Figure 1:
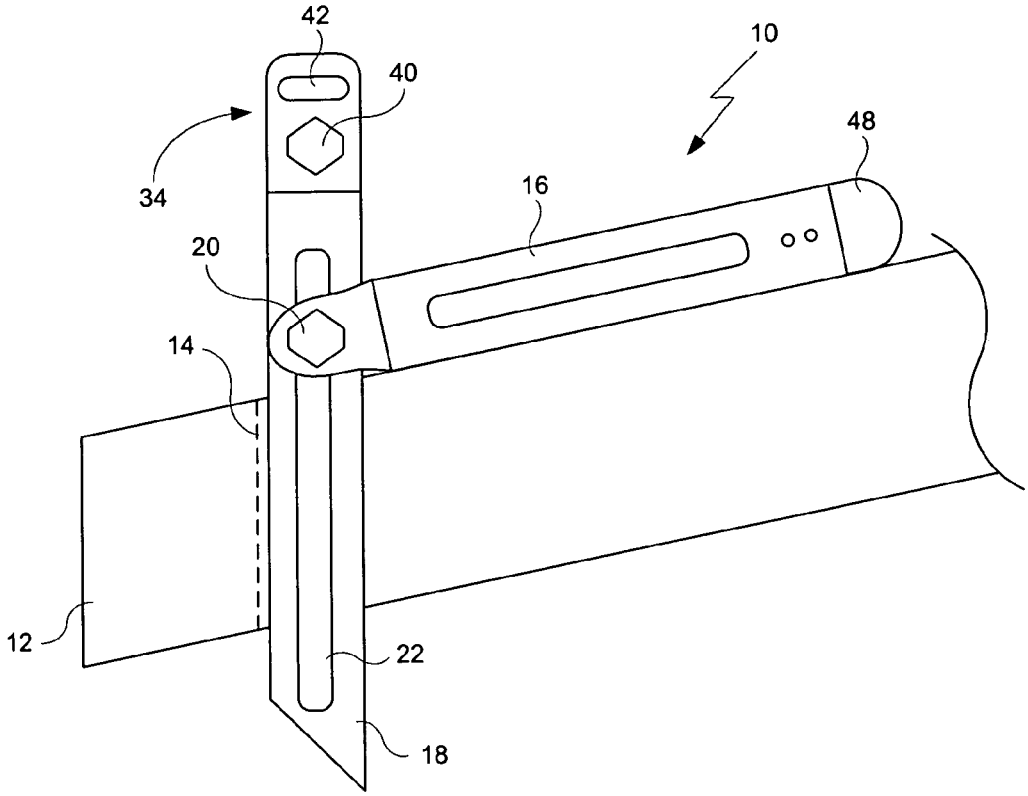
FIG. 1 is a side view of the t-bevel plumb tool shown in use to layout a plumb line on a rafter tail.
Figure 2:
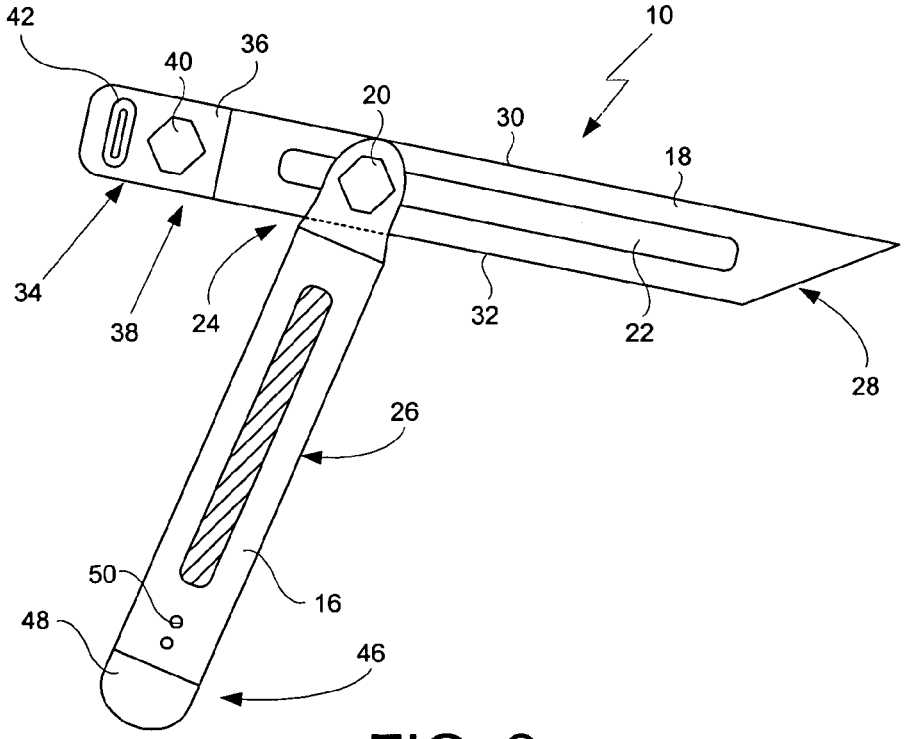
FIG. 2 is a top view of the t-bevel plumb tool configured according to the principles and having the components of the present invention.
Figure 3:
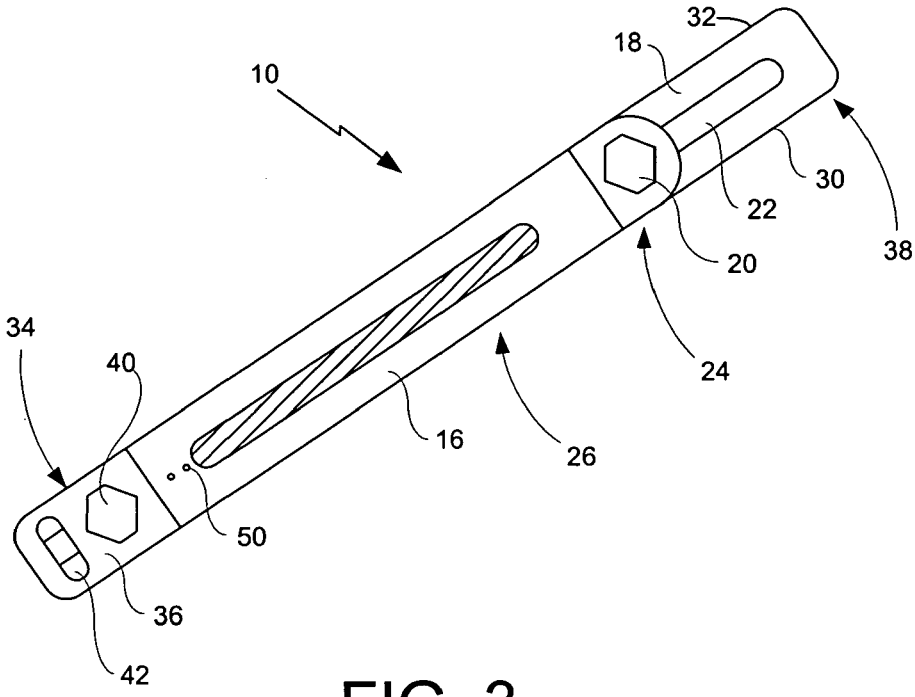
FIG. 3 is a top view of the t-bevel plumb tool shown having the blade and handle in a linear relationship with the blade partially disposed in the handle.

A t-bevel plumb tool that is manufactured out of the materials and configured pursuant to the present invention is shown generally as 10 in the figures. As shown in FIG. 1, t-bevel plumb tool 10 can be utilized to mark a rafter tail 12 with a plumb line 14 so that the rafter tail 12 can be cut for installation of the fascia board (not shown). As best shown in FIG. 2, the t-bevel plumb tool 10 of the present invention comprises some of the same familiar components of a standard t-bevel, namely handle 16, blade 18 and blade locking mechanism 20. As known to those skilled in the art, blade 18 has a blade slot 22 disposed therein and locking mechanism 20 is configured such that blade 18 is slidably connected to the first end 24 of handle 16. Locking mechanism 20 can be a hex nut, wing nut or other type of locking member that is configured to be disposed through blade slot 22 and lock, typically by clamping, blade 18 in the desired position (i.e., at a specific angle or linear relative to handle 16). As with the typical t-bevel, handle 16 is configured with a slotted chamber (not shown) on the side 26 thereof that is adapted to receive first end 28 of blade 18 therein so the t-bevel plumb tool 10 can be folded with blade 18 and handle 16 in a generally linear relationship (as shown in FIG. 3) when not in use. Blade slot 22 is also configured to allow the user to adjust the distance first end 28 extends outwardly from handle 16. Side edges 30 and 32 of blade 18 are configured to be substantially parallel and smooth so the user of t-bevel plumb tool 10 can utilize side edges 30 and 32 of blade 18 as a straightedge for drawing plumb line 14, measuring angles or for other straightedge purposes.

Figure 4:
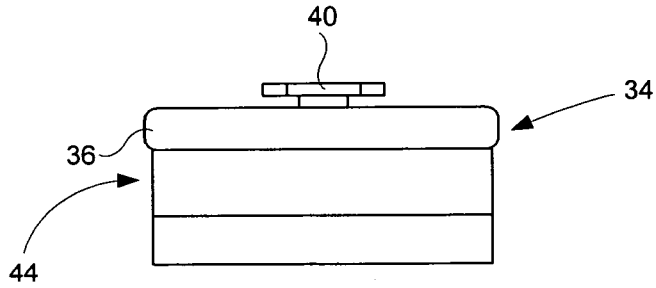
FIG. 4 is an end view of the plumb indicator configured for use with the t-bevel plumb tool of the present invention.

The improvement of the t-bevel plumb tool 10 of the present invention comprises the addition of plumb indicator 34 thereon for use in determining a plumb or level condition. In the preferred embodiment, shown in the figures, plumb indicator 34 comprises a sleeve member 36 configured to be removably attached to the second end 38 of blade 18 with a plumb securing mechanism 40. Plumb indicator 34 is provided with a plumb indicating mechanism 42, such as a typical bubble vial that is configured with a bubble and a pair of parallel lines to indicate the plumb or level status of a component. As shown in FIG. 4, sleeve member 36 is provided with a sleeve slot 44 sized and configured to receive the second end 38 of blade 18. Plumb securing mechanism 40 cooperates with sleeve member 36 to engage the second end 38 of blade 18 in sleeve slot 44 when the user desires to utilize the t-bevel plumb tool 10 of the present invention (i.e., as shown in FIG. 1). As with locking mechanism 20 that interconnects blade 18 to handle 16, plumb securing mechanism 40 can be a hex nut (shown), wing nut or similar locking members that are configured to engage second end 38 of blade 18 in sleeve member 36. As stated above, in a preferred embodiment the plumb indicator 34 removably attaches to second end 38 of blade 18. Typically, second end 38 of blade 18 is configured for being directly received in sleeve slot 44. If necessary, however, second end 38 of blade 18 can be configured with an extension member or other component (not shown) that is specially configured to be received in sleeve slot 44 of sleeve member 36. Although not necessarily preferred, plumb indicator 34 can be configured to be fixedly attached or integral with second end 38 of blade 18 or, if the slotted chamber of side 26 of handle 16 is appropriately sized, in the body of blade 16 or at/near first end 28 of blade 18.

Figure 5:
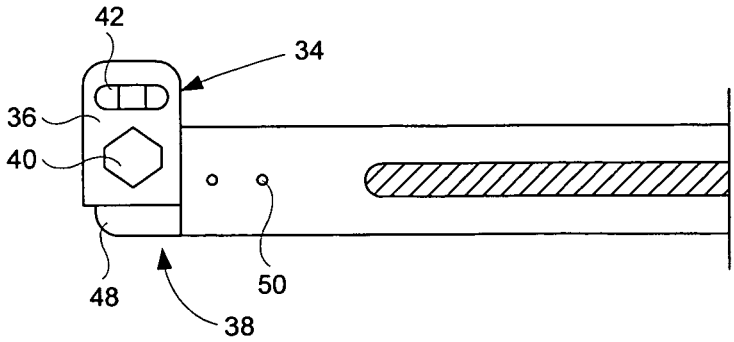
FIG. 5 illustrates an alternative use of the t-bevel plumb tool of the present invention as a level.

In the preferred embodiment of t-bevel plumb tool 10 of the present invention, the second end 46 of handle 16 is configured with an extension member 48 that is sized and configured to be received in sleeve slot 44 so that plumb indicator 34 can be removably mounted thereon, as shown in FIG. 3. In a preferred embodiment, extension member 48 will typically have a reduced thickness relative to handle 16 such that when plumb indicator 34 is mounted thereon the surface of plumb securing mechanism 40 above sleeve member 36 will be substantially flush with the surface of handle 16. As shown in the figures, one or more connecting elements 50 can be utilized to connect extension member 48 to second end 46 of handle 16. Alternatively, extension member 48 can be made integral with second end 46 of handle 16. The configuration of FIG. 3 is primarily how it is anticipated that the user will carry plumb indicator 34 when t-bevel plumb tool 10 is not in use. Although tool 10 can be used as a vertical level with plumb indicator 34 mounted on extension member 48 at second end 46 of handle 16 as shown in FIG. 3, this is not the primary purpose of t-bevel plumb tool 10 of the present invention. As shown in FIG. 5, plumb indicator 34 can be removably mounted on extension member 48 in a sideways manner such that t-bevel plumb tool 10 can be utilized as a level.

In a preferred embodiment of the t-bevel plumb tool 10 of the present invention handle 16 and blade 18 are made out of aluminum or other generally lightweight, durable and corrosion resistant materials. Locking mechanism 20 and plumb securing mechanism 40 can be made out of brass, steel, stainless steel or other suitable materials. Bubble vial 42 can be the standard acrylic or glass vials (or made of other see-through materials) that are utilized with commonly available levels and leveling devices. Preferably, t-bevel plumb tool 10 is provided with a handle 16 and blade 18 that is longer than that which is commonly available with standard t-bevels. For instance, in one embodiment handle 16 is approximately eight to sixteen inches long and blade 18 is approximately twelve to eighteen inches long. The longer lengths make the tool 10 more useful for wider structural components (such as 2×12s and the like) and for use with siding.

In use, the t-bevel plumb tool 10 of the present invention is typically carried as shown in FIG. 3, with the handle 16 and blade 18 in a generally linear relationship. To use the tool 10, the user loosens plumb securing mechanism 40 and removes plumb indicator 34 from the extension member 48 at the second end 46 of handle 16. The plumb indicator 34 is attached to the second end 38 of blade 18, as shown in FIGS. 1 and 2, and plumb securing mechanism 40 is operated to tightly engage plumb securing mechanism 40 with blade 18. The user can then utilize tool 10 (as an example) with rafter tail 12 to quickly, easily and accurately draw plumb line 14 thereon. As will be readily recognized by those skilled in the art, t-bevel plumb tool can also be utilized to find roof pitch, set cabinets plumb, hang straight fascia as well as many other uses. When the user is done using tool 10, he or she can loosen plumb securing mechanism 40 to remove plumb indicator 34 from the second end of blade 18 and reattach it to the extension member 48 at the second end 46 of handle 16, as shown in FIG. 3.

Figure 6:
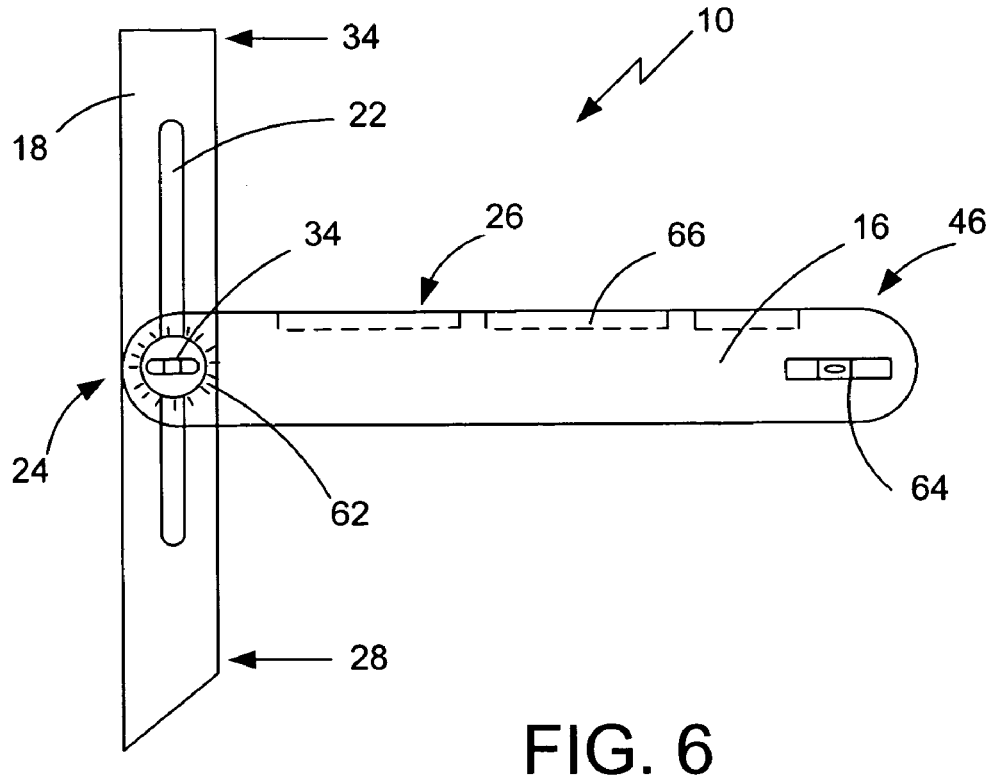
FIG. 6 is a top view of a second embodiment of the t-bevel plumb tool of the present invention with the plumb indicator built into the first end of the handle and a level indicator at the second end of the handle.
Figure 7:
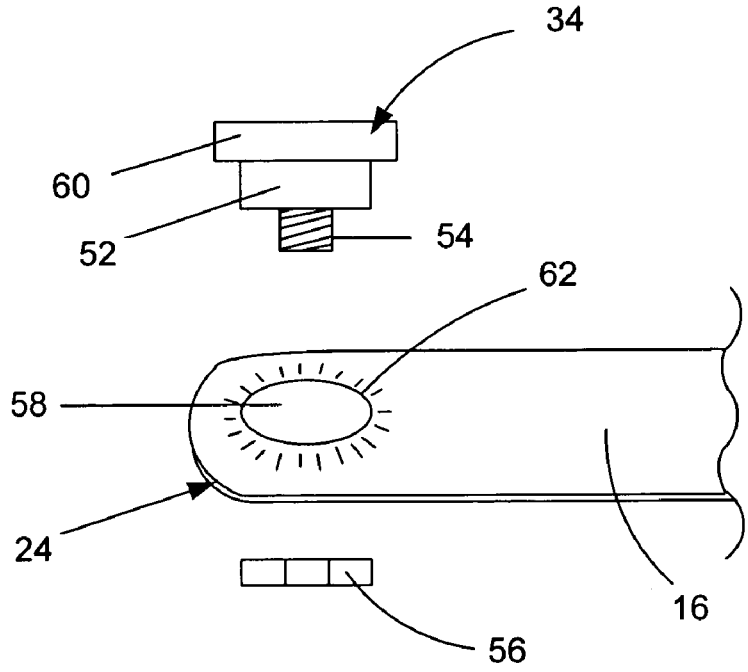
FIG. 7 is a exploded perspective view of a plumb indicator and the second end of the handle configured for use with the embodiment of the t-bevel plumb tool shown in FIG. 6.

In a second embodiment of the t-bevel tool of the present invention, shown in FIGS. 6 and 7, the plumb indicator 34 is positioned in the handle 16, such as at or near the first end 24 of handle 16. In this embodiment, plumb indicator 34 incorporates locking mechanism 20, as best shown in FIG. 7. Plumb indicator is attached to base member 52 from which outwardly extends threaded member 54 that is configured to extend through and engage slot 22 of blade 19 and threadably attach to nut 56 so as to releasably secure blade 18 on handle 16. To best receive plumb indicator 34, the first end 24 of handle 16 is provided with a cavity 58 sized and configured to receive base member 52 therein. Preferably, the connection between base member 52 and slot 22 of blade 18 and the size/configuration of cavity 58 is such that bubble vial portion 60 of plumb indicator 34 rotates within cavity 58 with the pivoting of blade 16. As with the typical t-bevel tool, the locking mechanism 20 of the plumb indicator 34 of this embodiment is configured to allow the user to pivot blade 18 so as to obtain or measure the desired angular relationship between blade 18 and handle 16. To assist the user with the position of blade 18 relative to handle 16, the periphery of cavity 58 can be provided with a plurality of angle markings 62. A horizontal level indicator 64 can be built-in or otherwise incorporated into handle 16, such as at or near the second end 46 of handle 16 as shown in FIG. 6. In the preferred configuration of this embodiment, handle 16 also has one or more magnets, shown as 66 in FIG. 6, along one or both sides 26 thereof, for use of t-bevel plumb tool 10 with steel or other materials, such as steel beams and the like.

While there are shown and described herein certain specific alternative forms of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to the dimensional relationships set forth herein and modifications in assembly, materials, size, shape, and use. For instance, there are numerous components described herein that can be replaced with equivalent functioning components to accomplish the objectives of the present invention and various components that can be made integral or in connecting relationship to each other. One such modification is the use of different materials than those set forth herein.

What is claimed is:

1. A t-bevel plumb tool configured to define a plumb line, comprising:

a handle having a first end and a second end;

a blade pivotally attached to said first end of said handle, said blade having a first end, a second end, a pair of side edges and a blade slot disposed between said first end and said second end; and a plumb indicator at said first end of said handle, said plumb indicator having a means disposed in said blade slot for locking said blade relative to said handle, said plumb indicator configured so one of said pair of side edges define said plumb line.

2. The t-bevel plumb tool according to claim 1, wherein said plumb indicator is disposed in a cavity at said first end of said handle.

3. The t-bevel plumb tool according to claim 2, wherein said plumb indicator comprises a base member configured to be received in said cavity.

4. The t-bevel plumb tool according to claim 3, wherein said locking means comprises a threaded member attached to said base member and a nut configured to be threadably received on said threaded member.

5. The t-bevel plumb tool according to claim 4, wherein said threaded member cooperatively engages said blade slot to rotate said plumb indicator with the pivoting of said blade.

6. The t-bevel plumb tool according to claim 2 further comprising a plurality of angle markings disposed around the periphery of said cavity.

7. The t-bevel plumb tool according to claim 1 further comprising a level indicator disposed in said handle.

* * * * *